United States Patent [19]

Groft et al.

[11] 3,950,070

[45] Apr. 13, 1976

[54] FLAT FLEXIBLE CABLE TERMINAL AND ELECTRICAL INTERCONNECTION SYSTEM

[75] Inventors: James Leon Groft, Camp Hill; Jean Jacques Redslob, Wellsville; Marvin Leo Yeager, Carlisle, all of Pa.

[73] Assignee: AMP Incorporated, Harrisburg, Pa.

[22] Filed: June 25, 1974

[21] Appl. No.: 482,969

[52] U.S. Cl. .... 339/217 S; 339/176 MF; 339/252 P

[51] Int. Cl.[2] .... H01R 9/08

[58] Field of Search .... 339/217 R, 217 S, 258 R, 339/258 S, 176 M, 176 MF, 176 P, 17 F, 198 P, 252 R, 252 P, 97 C, 47 R, 48, 49 R, 217 PS

[56] References Cited

UNITED STATES PATENTS

| | | | |
|---|---|---|---|
| 3,196,380 | 7/1965 | Krehbiel | 339/217 S |
| 3,201,744 | 8/1965 | Dean | 339/17 F |
| 3,299,396 | 1/1967 | Kinkaid | 339/217 S |
| 3,555,494 | 1/1971 | Baumanis | 339/217 S |
| 3,696,322 | 10/1972 | Spangler et al. | 339/97 C |
| 3,824,524 | 7/1974 | Glover | 339/217 S |
| 3,824,528 | 7/1974 | Esser | 339/97 C |

FOREIGN PATENTS OR APPLICATIONS

| | | | |
|---|---|---|---|
| 6,412,180 | 4/1965 | Netherlands | 339/176 M |
| 1,309,299 | 10/1962 | France | 339/97 C |

OTHER PUBLICATIONS

R. King, Blue Ribbon Connectors, Amphenol Engineering News, Nov. 1954, p. 261.

*Primary Examiner*—Joseph H. McGlynn
*Assistant Examiner*—James W. Davie
*Attorney, Agent, or Firm*—Russell J. Egan

[57] ABSTRACT

A hermaphroditic electrical contact is disclosed for use with multiple conductor flat flexible cables terminated by elongated mating plug and receptacle connectors. A plurality of contacts are mounted in each of the connectors. Each contact includes a resilient cantilever contact arm integral with and extending along a contact body. The arm is formed of light spring stock and is shaped to permit over center motion. The free end of the arm is profiled to engage tabs on the body which restrain movement of the arm. Fixed tabs and a resilient latch extend from the contact body to allow easy mounting in the plug and receptacle connectors. The spring latch can be depressed to permit the contacts to be easily removed from the connector assembly without damage. The contacts also include staggered pairs of sharpened teeth which are capable of penetrating cable insulation and being crimped or bent in a curled relationship over the margins of a flat configuration conductor to inwardly deform and resiliently pinch the conductor side margins at a plurality of locations. The edges of the teeth are sufficiently sharp to insure penetration through the insulation jacket to establish the desired electrical connection with the inwardly crimped portion of the conductor.

16 Claims, 8 Drawing Figures

Fig. 1
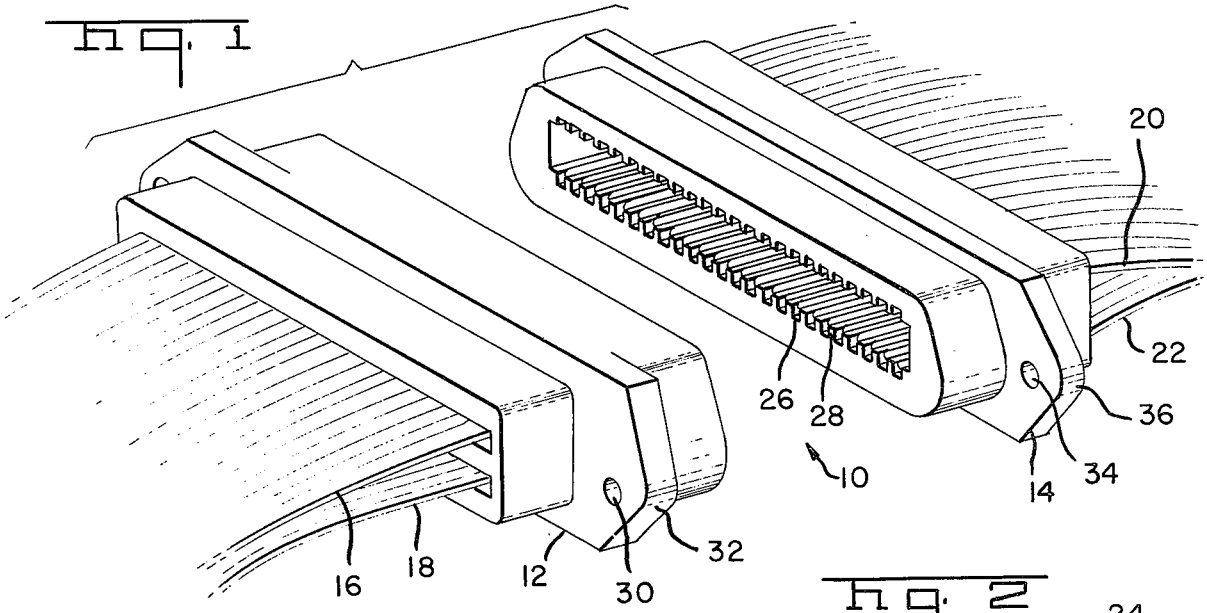
Fig. 2
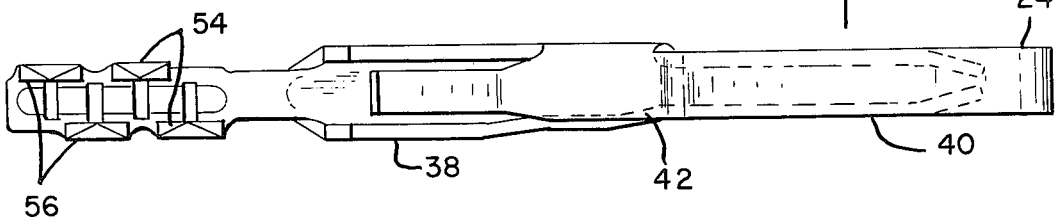
Fig. 3
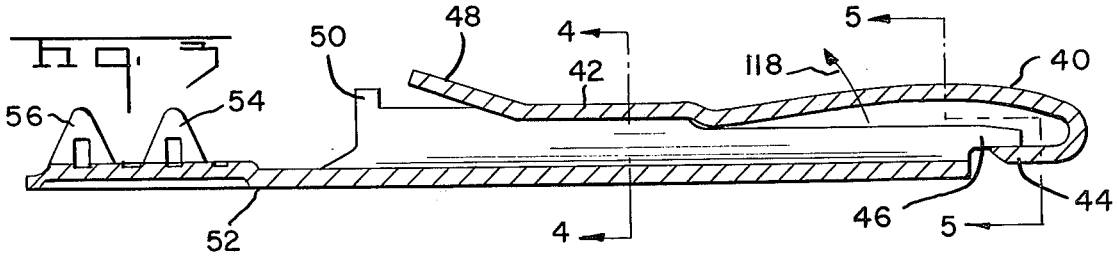
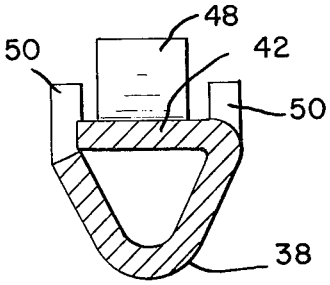
Fig. 4
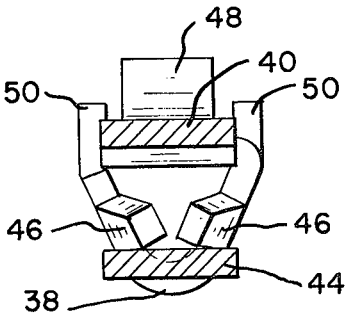
Fig. 5

FLAT FLEXIBLE CABLE TERMINAL AND ELECTRICAL INTERCONNECTION SYSTEM

BACKGROUND OF THE INVENTION

1. The Field Of The Invention

This invention relates to an improved electrical contact and more particularly to a contact used in elongated mating plug and receptacle connectors terminating multiple flat conductor cable.

2. The Prior Art

The wide spread use of multiple conductor electrical connectors in communications equipment, data processing equipment, and other related equipment, has caused a continuous need for improved conductor assemblies and for improved contact structures for use in such assemblies. However many problems must be solved in designing such connectors and contact structures to obtain the maximum flexibility and use of these devices.

One such problem is that of compatibility. More particularly it is not practical to design new connector or contact structures unless they are compatible with existing equipment, since it is prohibitively expensive to replace a large number of existing connectors each time an approved device becomes available. New connectors and contacts must therefore be designed within the constraints opposed by the requirement of compatibility with existing equipment.

All electrical connector and contact structures must also be constructed to guarantee a positive electrical connection when they are in use. This is often done by making the cooperating contact elements resilient. However, in multiple conductor devices, dozens of resilient contact structures are often pressed into engagement with one another. If each of the contacts includes a stiff spring member to guarantee a positive electrical connection, a tremendous force could be required in order to mate the plug and receptacle components of a multiple conductor connector. Therefore each contact structure must be designed to have a resilient contact surface for guaranteeing a positive electrical connection but must have a spring force which is sufficiently light that the plug and receptacle portions of the connector can be mated with a minimum of force. Yet the contact structure must also be formed so that the light spring portion maintains its shape and resiliency and insures a positive electrical connection each time the connector portions are mated.

The problem of assembling and repairing multiple conductor assemblies is also highly significant since each connector may include dozens of individual contacts. The contacts therefore must be designed such that they can easily be assembled into the body of the conductor. It is also important that the contacts be designed so that they can be easily removed if damaged or worn out. Furthermore it is preferable that the contacts be designed so that they can be used in both plug and receptacle portions of a multiple conductor connector assembly since use in both portions of a connector eliminates a need for separate inventories of contacts and also reduces manufacturing costs. The manufacturing cost is also preferably minimized by designing the contact structure so that it can be formed with a minimum number of manufacturing steps from a single piece of metal.

An additional problem existing in the prior art is the lack of a connector which provides adequate solutions for the problems described above and is also capable of use with multiple flat conductor flexible cable. The use of multiple flat conductor flexible cable is extremely convenient and desirable in many situations and accordingly a need exists for a conductor which is capable of wide spread practical utility with such cable. Although connector and contact structures available in the past have attempted to resolve one or more of the problems discussed above, none has been completely successful in resolving all of them. Accordingly connector and contact structures available in the past have all included one or more undesirable features which cause them to perform unsatisfactorily or be unreasonably costly to manufacture or be extrodinarily difficult to assemble. Consequently there is need for an improved connector assembly and contact structure which resolves in a satisfactory manner the problems set forth hereinabove and other related problems.

SUMMARY OF THE INVENTION

The present invention includes an improved electrical contact for use in terminating multiple flexible cable with the contact including a V-shaped channel body portion, a cantilever contact arm integral with and extending along said body, said arm having a light spring force, a flexible latch means on the end of the body engaging the free end of the contact arm to both preload the arm and limit its movement, at least one mounting tab projecting from the body for mounting the contact in an associated connector housing, and a web portion extending from said body portion having first and second pairs of spaced apart teeth projecting from each side of the web portion. The teeth are sharpened to pierce through the insulation covering a multiple flat conductor flexible cable to engage side portions of the conductors and then be folded upon themselves to again penetrate and resiliently engage the conductor forming a good electrical and mechanical engagement therewith.

It is therefore an object of the present invention to produce an improved electrical contact which may be stamped and formed from a single metal blank and which can engage with multiple flat conductor flexible cable.

It is yet another object of the present invention to produce an improved electrical contact which can be stamped and formed from a single piece of metal for use in terminating closely spaced conductors of multiple flat conductor flexible cable and for interengaging with like contacts mounted in mating connector members.

It is still another object of the present invention to produce a novel contact structure which is suitable for use in multiple conductor assemblies and which is particularly compatible with existing equipment.

It is yet another object of the present invention to produce an improved contact structure and associated connector assembly which can be readily and economically produced.

The means for accomplishing the foregoing and other objects of the present invention will become apparent to those skilled in the art from the following detailed description taken with reference to the accompanying drawings illustrating a preferred embodiment of the invention.

BRIEF DESCRIPTION OF THE DRAWINGS

FIG. 1 is a perspective view of a multiple conductor connector assembly according to the present invention;

FIG. 2 is a top plan view of a contact according to the present invention;

FIG. 3 is a longitudinal section through the subject contact taken along line 3—3 of FIG. 2.

FIG. 4 is a transverse section through the subject contact taken along line 4—4 of FIG. 3;

FIG. 5 is a transverse section through the subject contact taken along the line 5—5 of FIG. 3;

DESCRIPTION OF THE PREFERRED EMBODIMENT

Figure 6:
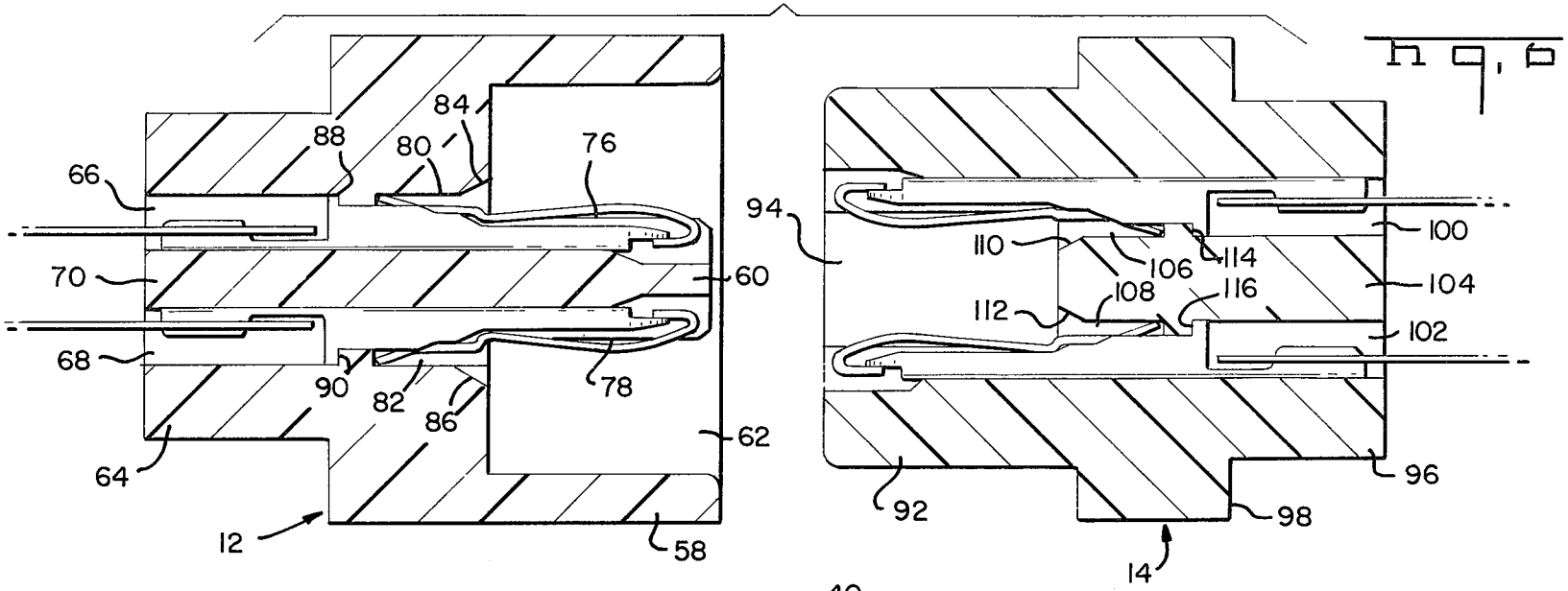
FIG. 6 is a section through the connector assembly of FIG. 1 showing the contacts mounted in the connector members.

Referring now to the drawings, wherein like reference numerals designate identical or corresponding parts throughout the several views, a preferred embodiment of the subject connector assembly is shown and indicated generally by the reference numeral 10. The connector assembly includes a plug member 12 and a receptacle member 14 which are adapted to be mated together. Both the plug 12 and the receptacle 14 are formed of conventional dielectric or insulating material. First and second multiple flat conductor flexible cables 16, 18 are shown terminated at the plug 12 while equivalent multiple flat conductor flexible cable conductors 20, 22 are shown terminated at the receptacle 14. It will also be apparent that while multiple flat conductor flexible cables are preferred, there are other equivalent types of conductors which may be used with the subject connector assembly 10. A plurality of contacts 24 are mounted in the receptacle 14 lying in a like plurality of grooves 26 which are separated by ridges 28. In other words, the ridges 28 are of insulating or dielectric material and serve to electrically isolate the contacts 24 one from the other. It will also be noted from the FIGURES that the contacts are arranged in upper and lower rows corresponding to the upper and lower cables attached to the connector assembly. The mating face of the plug 12 likewise includes two rows of contacts separated by ridges, as will be noted from the section view of FIG. 6. Apertures 30 are formed in flange 32 of the plug while corresponding apertures 34 are formed in flange 36 of the receptacle and are used to secure the mating connector halves together by conventional means, not shown.

Referring now to FIG. 2, the subject contact 24 includes a V-shaped body portion 38 having a resilient cantilever spring arm 40 integrally connected to one side of the body by bridge 42. The arm 40 extends along the body with the forward free end of the arm folded about itself to form a hooked extension 44 which engages locking tabs 46 on the free end of the body 38. An upwardly directed locking lance 48 extends integrally rearwardly of the bridge 42. A pair of rigid stop members 50 are formed at the rear end of the V-shaped body. An integral extension 52 is directed rearwardly of the body and has mounted thereon first and second pairs of teeth 54, 56, respectively, which are in a staggered arrangement.

Figure 8:
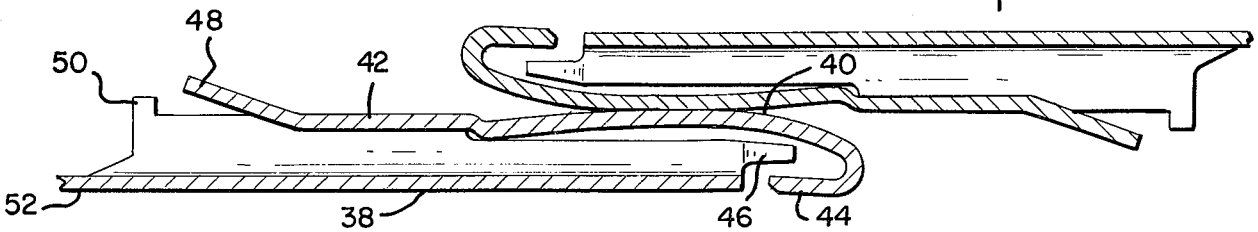
FIG. 8 is a plan view of the blank used to form the subject contact.

The blank from which the subject contact is made is shown in FIG. 8. It will be readily apparent that this blank presents a narrow profile which allows the contacts to be closely spaced on the strip. This feature generates very little waste material during the stamping of the contact but more importantly spaces the contacts to allow for gang crimping. Previous contacts have been so widely spaced apart they they had to be sequentially attached to conductors.

The plug and receptacle members are shown in FIG. 6 prior to mating. The plug 12 is formed of a dielectric material having a shield portion 58 extending forwardly therefrom towards the mating face of the receptacle 14. A bar 60 protrudes from a central portion of the plug body and also extends towards the mating face of the receptacle. A receptacle receiving aperture or elongated opening 62 is defined by the area between the shield portion 58 and a central bar 60 of the plug 12. The receptacle receivng aperture extends above and below the central bar. A neck portion 64 of reduced thickness extends from the rear of the body away from the mating surface of the plug. A pair of conductor receiving apertures 66, 68 are formed in the neck portion 64 and are divided by a rearward extension 70 of the central bar 60. A plurality of contact grooves or slots 72, 74 are formed along the central bar and are separated by a plurality of ridges 76, 78. It will be apparent that the grooves and ridges are substantially equivalent to the above described grooves and ridges of the receptacle. It will further be apparent that the contact grooves and ridges extend along both the upper and lower surfaces of the central bar and there may be as many contact grooves and separating ridges as necessary to accommodate the desired number of contacts. The contact grooves or slots extend entirely through the dielectric body and provide channels of communication between the receptacle receiving aperture and the conductor receiving apertures. Latch channels 80, 82 having bevelled outer edges 84, 86 are provided in the dielectric body at the various locations where the contact grooves pass through the main portion of the plug body. The contact latch channels 80, 82 are narrower than that contact grooves 72, 74 and are designed to receive resilient latches 48 associated with each contact, as described above with regard to the contact itself. A nub 88, 90 is formed integral with the dielectric body and is provided at the rear portion of each latch channel and also serves to engage locking members 50 for holding the contacts in place in the manner described with relation to the mounting of the contacts.

It will be apparent to those skilled in the art that the receptacle is designed to interfit with the plug and is substantially identical in structure. It has a neck portion 92 extending toward the mating surface of the receptacle. On the upper and lower surfaces of the neck portion are previously described grooves 26 and ridges 28 in which the contacts 24 are positioned. A plug receiving aperture 94 is defined between the open area of the neck portion and is adopted to receive the central bar of the plug. A like second neck portion 96 extends from the rear of the body and is similar to that portion of the plug 12. A ledge 98 is formed on the outer periphery of the dielectric body separating the neck portions. A pair of wire receiving apertures 100, 102 are formed in neck portion 96 for receiving flat flexible cable conductors 20, 22. A central bar 104 formed integral with the body separates the two wire receiving apertures. Latch channels 106, 108 having bevelled edges 110, 112 are formed on opposite sides of the central bar and at the end thereof which is near the mating surface of the receptacle 14. The latch channels are substantially identical to the latch channels of the plug and serve the same purpose. Similar nubs 114, 116 are formed on the central bar and serve the same function as the nubs of the plug 12. It will be noted however that the latch channel and the nub structures of the receptacle are inverted with respect to those of the plug. Thus it will be apparent that contacts inserted into the receptacle are inverted in orientation with respect to those in the plug.

The contact is formed from a single blank (see FIG. 8) of resilient highly conductive material of the type commonly used for contact structures. The contact is formed to include an elongated, V-shaped body member 38 which extends in a forward direction to tapered guide members 46 and in the opposite direction to a conductor coupling portion 52 formed by pairs of staggered, spaced apart deformable teeth 54, 56 which are adapted to be bent inwardly toward one another to firmly grip the conductor of a multiple flat conductor flexible cable therebetween. Naturally the deformable teeth can also be used to grip similar types of conductors. Between the wire coupling portion and the body portion are positioned to a pair of upstanding tabs 50 which are formed integral with the body and function to secure the contact in position within the connector assembly. The cantilever contact arm 40, which has a light spring force, is formed integral with a bridge portion 42 of the contact and a flexible latch 48 is formed integral with the bridge extending oppositely from the arm and facilitates the mounting and removal of the contact in the connector assembly. The cantilever contact arm includes a lip portion 44 which is normally hooked over one end of the guide members 46. Thus the resilient contact arm is normally captured or retained in place by the guide members so that the light spring material of the contact arm retains its shape properly when not in use and cannot be dislocated to inadvertantly short with the opposite contact. It will also be apparent that the contact arm is curved or bowed outwardly along its longitudinal axis to permit an over center action when the contact is used. The contact is purposely pre-stressed to store spring energy tending to pivot the arm in a counter clockwise fashion outwardly from the end of the guide member, as shown by the arrow 118 in FIG. 3. The lip portion 44 thus retains the arm 40 against resilient spring energy stored in the pre-stressed spring arm.

The teeth 54, 56 are sufficiently sharp that they will penetrate insulation covering the conductors in the cable. The insulation is pierced initially by the upstanding teeth, as shown in FIGS. 2 and 3, and again as the teeth are bent inwardly upon themselves to form the crimp connection with the conductor. The contact is preferably positioned with respect to the flat conductor so that the teeth initially engage opposite side edges of the conductor. The points of the teeth penetrate an inner portion of the conductor making secure electrical and mechanical connection therewith. The teeth also butt against the coupling portion with somewhat of a resilient action. This prevents undo tearing of the conductor.

The contacts are inserted into their related portions of the connector assembly by first being gang crimp connected to a suitable multiple flat conductor flexible cable by appropriately deforming the teeth portions thereof. The contacts are then simply inserted in gang fashion, with the proper orientation into, the wire receiving apertures of the plug or of the receptacle. As the contacts slide through the grooves of the plug or receptacle, the nubs depress the resilient latches of the contact. The latch thus rides over the top of the appropriate nub and then springs outwardly to engage edge of the latching channel. In this position the upstanding tabs are firmly engaged with the edge of the nub while the latch firmly holds the contact in place with respect thereto. Thus it will be seen that the contact structure of the present invention is very easily mounted in a connector assembly. In addition it is clearly seen that according to the present invention a single type of contact structure is used in both the plug and receptacle portions of the connector assembly. The contacts in the plug 12 rest against the central bar and face outwardly therefrom while the contacts in the receptacle are oriented such that they abut the inner surface of the neck portion and face inwardly therefrom. Accordingly the contacts of the plug and receptacle portions of the conductor assembly are oriented to engage one another when the connector portions are mated. The contacts are also easily removed for servicing and repair by simply inserting a special tool simultaneously into all the latch channels to depress the latches of the contacts, and allow them to slide over the respective nubs to permit the contacts to be withdrawn rearwardly therefrom.

Figure 7:
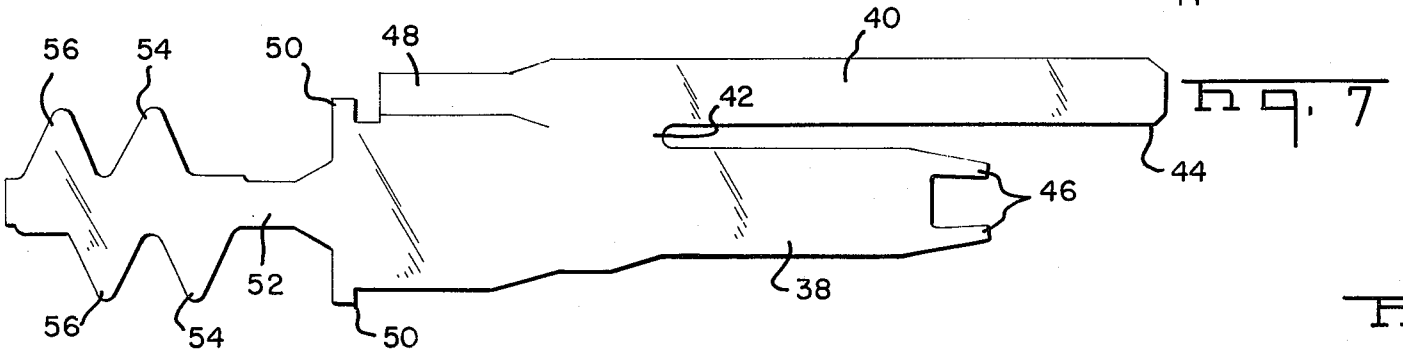
FIG. 7 is an enlarged partial longitudinal section, similar to FIG. 3, showing the engagement of two mating contacts.

The contacts of FIG. 7 are shown engaging one another as they would each time the plug and receptacle portions of the connector are mated. As shown the resilient contact arms of the contacts are in engagement over a large percentage of their longitudinal lengths. This relatively large contact area is provided in part by the over center action of the contact arms. More particularly the contact arms have a slightly outwardly bowed shape, as described with reference to FIG. 3. When two such contact arms come into engagement, the over center action causes them to flatten out somewhat so that they are pressed into firm engagement over a substantial portion of their respective lengths. In addition, the structure of the contacts provide a large wiping area between the two contact arms as the contact arms are brought into engagement. The contact arms produce a wiping action which tends to remove any dirt, oxides, or corrosion which is formed on the contact arms and thereby insure a positive low resistance contact when the two arms come into engagement. The contact arms are bent downwardly at their forward end portions to form inclined areas to insure that the contact arms will slide over one another in proper fashion.

The present invention may be subject to many modifications and changes without departing from the spirit or essential characteristics thereof. The present embodiment should therefore be considered in all respects as being illustrative and not restrictive of the scope of the invention.

What is claimed is:

1. A multiple conductor electrical connector comprising:

plug means including a first body of dielectric material;

receptacle means including a second body of dielectric material;

a plurality of contact receiving channels in each said first and second bodies of dielectric material;

a like plurality of nubs formed integral with said first and second bodies of dielectric material and positioned such that one nub projects into each of said contact receiving channels;

a plurality of contacts each located in a respective one of said plurality of contact receiving channels, each said contact including a unitary body of conductive material, said body having a pair of integral inclined sidewalls defining a V-shaped section with an open third side, a bridge extending at least partially across the open side of said body intermediate the ends thereof, a light spring force resilient cantilever contact arm integral with and extending from a first side of said bridge forwardly along said open side of said body and having a curved free end hooking around one free end of the body, a flexible latch means integral with and extending from an opposite side of said bridge rearwardly along said body, at least one rigid restraining tab integral with said body and spaced from said latch means, and means for attachment of said contact to an electrical conductor;

said latch means and said at least one restraining tab interfitting with said nubs to retain said contacts firmly in place within said contact receiving channels.

2. A multiple conductor electrical connector according to claim 1, wherein:

said flexible latch means comprises a resilient strip oriented at an acute angle with respect to the longitudinal axis of said contact.

3. A multiple conductor electrical connector according to claim 1, wherein:

said resilient cantilever contact arm is shaped to cause over-center motion when bent beyond a predetermined position.

4. A multiple conductor electrical connector according to claim 1, wherein:

said curved free end of said cantilever contact arm engages said one free end of said body whereby said contact arm is retained in predetermined position when no force is applied thereto.

5. A multiple conductor electrical connector according to claim 1, wherein:

said plug means includes an elongated bar portion and a shield member formed integral with and protruding from said first body of dielectric material, said shield member surrounding but spaced from said elongated bar portion.

6. A multiple conductor electrical connector according to claim 5, wherein:

said receptacle means includes a neck portion formed integral with said second body of dielectric material and protruding therefrom, said neck portion defining an aperture for receiving said elongated bar portion.

7. A multiple conductor electrical connector according to claim 6, wherein:

said elongated bar portion includes a first plurality of contact receiving channels along an upper surface thereof and a second plurality of contact receiving channels along a lower surface thereof, and said neck portion includes first and second pluralities of contact receiving channels along upper and lower inner surfaces thereof which are positioned to cooperate with said contact receiving channels of said elongated bar portion.

8. A hermaphroditic electrical contact comprising:

a unitary body of conductive material having a pair of integral inclined sidewalls defining a V-shaped section with an open third side, a bridge extending at least partially across the open side of said body intermediate the ends thereof, a light spring force resilient cantilever contact arm integral with and extending forwardly from a first side of said bridge along said body and having a curved free end hooking around a free end of the body, a flexible latch means integral with and extending from an opposite side of said bridge, at least one fixed restraining tab spaced from said latch means on one said sidewall of said body, and means for attachment of said contact to an electrical conductor.

9. An electrical contact according to claim 8 wherein said at least one tab is integral with one of said side walls.

10. An electrical contact according to claim 8 wherein:

said flexible latch means comprises a resilient strip oriented at an acute angle with respect to the longitudinal axis of said contact

11. An electrical contact according to claim 8 wherein:

said resilient cantilever contact arm is shaped to cause over-center motion when bent beyond a predetermined position.

12. An electrical contact according to claim 8 wherein:

said curved free end of said contact arm engages said one end of said body whereby motion of said arm is restrained to a predetermined position when no force is applied thereto.

13. An electrical contact according to claim 8 wherein:

said means for attachment of said contact to an electrical conductor comprises at least one pair of teeth which are spaced apart and staggered with respect to each other.

14. An electrical contact according to claim 13 wherein:

said teeth are spaced apart a distance substantially equal to the width of a conductor to be engaged therein.

15. An electrical contact according to claim 13 wherein said teeth are sufficiently sharp to penetrate insulation surrounding a conductor to be engaged therewith.

16. An electrical contact according to claim 13 wherein:

said teeth are crimped upon themselves to resiliently secure a conductor therein.

* * * * *